US010753095B2

(12) United States Patent
King

(10) Patent No.: US 10,753,095 B2
(45) Date of Patent: Aug. 25, 2020

(54) PRE-STRESSED CONCRETE STRUCTURE WITH GALVANIZED REINFORCEMENT

(71) Applicant: NV Bekaert SA, Zwevegem (BE)

(72) Inventor: Dale King, Van Buren, AR (US)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 16/617,678

(22) PCT Filed: May 28, 2018

(86) PCT No.: PCT/EP2018/063953

§ 371 (c)(1),
(2) Date: Nov. 27, 2019

(87) PCT Pub. No.: WO2019/001872

PCT Pub. Date: Jan. 3, 2019

(65) Prior Publication Data

US 2020/0123775 A1 Apr. 23, 2020

Related U.S. Application Data

(60) Provisional application No. 62/526,430, filed on Jun. 29, 2017.

(51) Int. Cl.
*E04C 5/08* (2006.01)
*E04C 5/01* (2006.01)
(Continued)

(52) U.S. Cl.
CPC ..... *E04C 5/08* (2013.01); *E04C 5/017* (2013.01); *E04C 5/03* (2013.01); *D07B 1/068* (2013.01);
(Continued)

(58) Field of Classification Search
CPC ..... E04C 5/08; E04C 5/03; D07B 2201/2011; D07B 2205/3025; D07B 2205/3071;
(Continued)

(56) References Cited

U.S. PATENT DOCUMENTS

2003/0106300 A1* 6/2003 Bruyneel ..... F16G 1/12 57/212
2007/0119715 A1 5/2007 Sacks et al.
2015/0043976 A1 2/2015 Defossez et al.

FOREIGN PATENT DOCUMENTS

CN 101 818 545 1/2013
EP 0 110 542 5/1980
(Continued)

OTHER PUBLICATIONS

International Search Report dated Aug. 22, 2018 in International Application No. PCT/EP2018/063953.
(Continued)

*Primary Examiner* — Patrick J Maestri
(74) *Attorney, Agent, or Firm* — Wenderoth, Lind & Ponack, L.L.P.

(57) ABSTRACT

A pre-stressed concrete structure comprises a steel wire or a steel strand. The steel wire or steel strand has been pre-tensioned before curing of the concrete or grout. The steel wire or steel strand is provided with a zinc coating. The zinc coating has a weight ranging between 70 g/m$^2$ and 950 g/m$^2$. The steel wire or steel strand has an outer surface that is provided with indentions to provide mechanical anchorage points in the concrete structure. The steel wire or steel strand is further provided with a passivation layer in the form of a metal oxide layer.

9 Claims, 3 Drawing Sheets

(51) Int. Cl.

| | |
|---|---|
| ***E04C 5/03*** | (2006.01) |
| *D07B 1/06* | (2006.01) |
| *D07B 5/00* | (2006.01) |

(52) U.S. Cl.
CPC ..... *D07B 1/0693* (2013.01); *D07B 5/005* (2013.01); *D07B 2201/1032* (2013.01); *D07B 2201/2002* (2013.01); *D07B 2201/2011* (2013.01); *D07B 2205/3025* (2013.01); *D07B 2205/3071* (2013.01); *D07B 2401/2025* (2013.01); *D07B 2501/2023* (2013.01); *D07B 2801/12* (2013.01); *D07B 2801/18* (2013.01)

(58) Field of Classification Search
CPC .... D07B 2401/2025; D07B 2501/2023; D07B 2801/18; D07B 2205/3092; D07B 1/06
See application file for complete search history.

(56) References Cited

FOREIGN PATENT DOCUMENTS

| | | |
|---|---|---|
| GB | 1 194 758 | 6/1970 |
| JP | 03-144048 | 6/1991 |
| JP | 11-302810 | 11/1999 |
| WO | 95/23277 | 8/1995 |

OTHER PUBLICATIONS

Written Opinion of the International Searching Authority dated Aug. 22, 2018 in International Application No. PCT/EP2018/063953.

* cited by examiner

PRE-STRESSED CONCRETE STRUCTURE WITH GALVANIZED REINFORCEMENT

TECHNICAL FIELD

The invention relates to a pre-stressed concrete structure.

BACKGROUND ART

In a pre-stressed concrete structure such as a concrete wall or a concrete beam a steel strand is tensioned and concrete is poured directly around the strand for curing, allowing bonding of the concrete with the strand.

Once cured, the steel strand tension is released resulting in compression of the concrete structure. The bond strength of the strand to concrete keeps the compression intact.

The prior art knows such pre-stressed concrete structures with uncoated steel strands.

Concrete is an alkaline environment and in quite some applications, there is no problem with the life time and corrosion of the reinforcing steel strands. However, in other more demanding applications, e.g. in marine environments, there is a huge demand to increase the life time of pre-stressed concrete structures, and, as a consequence the life time of the reinforcing steel strands.

Using galvanized steel strands did not result in reaching the same bond strengths as with uncoated steel strands, on the contrary, the bond strength of galvanized steel strands to cement or concrete was lower than with uncoated steel strands.

DISCLOSURE OF INVENTION

It is a general object of the invention to mitigate the drawbacks of the prior art.

It is a particular object of the invention to obtain pre-stressed concrete structures with a longer life time.

It is another object of the invention to increase the bond strength of steel strands to cement or concrete.

It is yet another object of the invention to increase the corrosion resistance of steel strands in pre-stressed concrete without deteriorating the bond strength of these steel strands in concrete.

According to the present invention there is provided a pre-stressed concrete structure comprising a steel strand or a steel wire. The steel strand or steel wire has been pre-tensioned before curing of the concrete or grout. The steel wire or the steel strand is provided with a zinc coating. The zinc coating has a weight ranging between 70 g/m$^2$ and 950 g/m$^2$. The steel wire or the steel strand has an outer surface that is provided with indentions to provide mechanical anchorage points in the concrete structure. In addition, the steel wire or the steel strand is provided with a passivation layer in the form of a metal oxide layer.

Within the context of the present invention, the terms "zinc coating" refer not only to a pure zinc coating but also to zinc alloy coatings, such as zinc aluminium alloy coatings and zinc aluminium magnesium alloy coatings.

The reason why uncoated steel strands have a better bond to the concrete than zinc coated steel strands, if no additional measures are taken, is due to the hydrogen evolution during the initial stages of curing of the concrete. The reaction of zinc in high pH wet concrete creates hydrogen gas, which leads to bubbles in the interface of steel with concrete which may lead to voids between the concrete and the steel strands. These voids reduce the friction resistance between the steel strand and the concrete and thus the bond strength between the steel strand and the concrete.

The above-mentioned indentions are now intended to bridge the voids and to restore the bond strength. The metal oxide layer is intended to modulate the reaction gases between the zinc and high pH concrete water to reduce the occurance of aforementioned voids. The combination effects of indentions and metal oxide layer is to increase the friction between the zinc coated strands and concrete.

Preferably, the steel wire or the steel strand has a yield strength that is more than or equal to 85%, e.g. more than or equal to 90% percent of the minimum guaranteed tensile strength. The advantage hereof is to reduce long term construction creep and maximize working capacity of the steel strands and the concrete structure.

The metal oxide layer on the surface of the galvanized steel strand or steel wire is an oxide layer selected from the group of zinc oxides, chromium oxides, zirconium oxides, aluminium oxides, titanium oxides or combinations thereof.

The reinforcing steel element can be single steel wire, or three steel wire strand (3×1) or a seven steel wire strand in a 1+6 construction, i.e. with one core wire and six wires in the mantle around the core.

The steel wires, either used singularly or as twisted multiple wires in a strand, may have a diameter ranging from 2.9 mm to 8.1 mm, e.g. from 3.0 mm to 7.0 mm.

The indentions may have a depth ranging from 0.05 mm to 0.20 mm, e.g. from 0.06 mm to 0.18 mm.

BRIEF DESCRIPTION OF FIGURES IN THE DRAWINGS

FIG. 1 is a cross-section of a single steel wire for reinforcing a pre-stressed concrete structure;

FIG. 2*a* and FIG. 2*b* are cross-sections of three wire steel strands for reinforcing a pre-stressed concrete structure;

FIG. 3*a* and FIG. 3*b* are cross-sections of 1+6 steel strands for reinforcing a pre-stressed concrete structure;

MODE(S) FOR CARRYING OUT THE INVENTION

Figure 1:
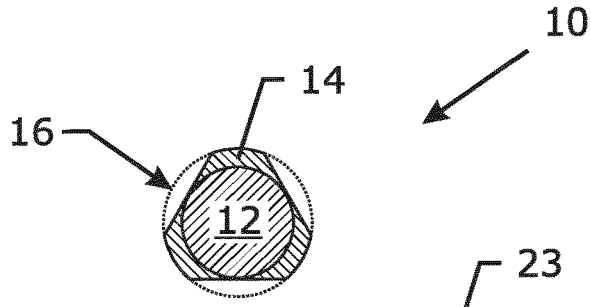

A galvanized steel reinforcement for a pre-stressed concrete structure is made along following lines.

A wire rod with a diameter ranging from 8 mm to 15 mm and a steel composition with a carbon content ranging from 0.70% to 0.95%, a silicon content ranging from 0.30% to 1.3%, a manganese content ranging from 0.30% to 0.80%, a sulphur content being below 0.025%, a phosphorous content being below 0.025%, the rest being iron and unavoidable impurities forms the starting product, all percentages being percentages by weight.

The wire rod is cold dry drawn until a wire is obtained with a final diameter between 3.0 mm and 7.0 mm.

The steel wire is then conducted to a hot dip galvanizing bath to provide the steel wire with a zinc coating ranging from 70 g/m$^2$ to 950 g/m$^2$, e.g. from 80 g/m$^2$ to 800 g/m$^2$. The wire may be used as "end galvanized" or "redrawn" with the zinc coating. The wires can then be indented in the final zinc surface to the specifications outlined in FIG. 4 (see further).

In case of a steel strand several wires, e.g. three steel wires or seven steel wires, are twisted into a steel strand, e.g. a 1×3 steel strand or a 1+6 steel strand.

The steel wire or the steel strand is then subjected to a relaxation process. More particularly, the steel wire or steel strand is heated under tension in order to obtain high yield strength.

After relaxation, mechanical indention is applied to the steel wire or steel strand. In the case of a steel strand this mechanical indention can also be applied on the individual steel wires before the twisting operation.

Finally, a passivation chemical is applied to the indented steel wire or steel strand to create a metal oxide on the surface. This metal oxide may reduce the hydrogen evolution during the initial stage of the curing process and may provide sufficient friction between the steel wire or steel strand and the concrete.

During the pouring of the concrete around the steel wire or steel strand, the steel wire or steel strand are kept under a tensile tension. After curing the tension is then released in order to put the concrete structure under compression.

FIG. 1 shows a cross-section of a steel wire 10. The steel wire has a steel core 12. On top of the steel core 12 is a zinc coating 14. The steel wire 10 is provided with indentions 16. Preferably the indentions are made in the zinc coating only.

Figure 2A:
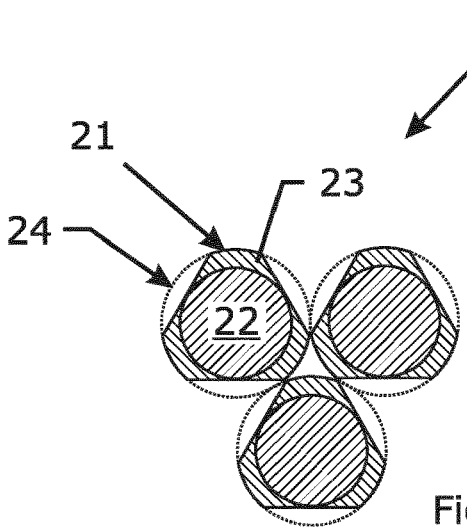
Figure 2B:
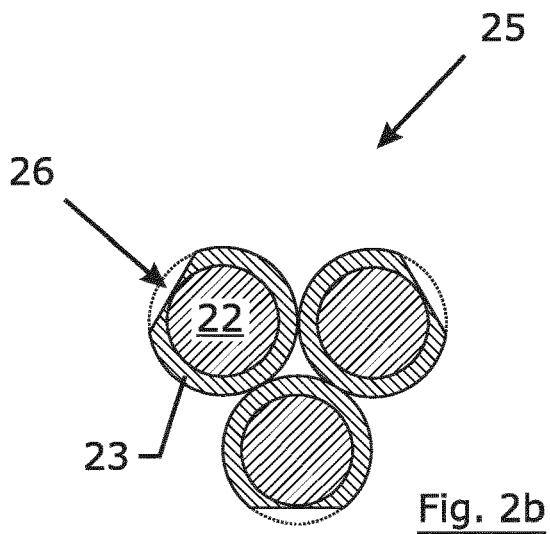

FIG. 2*a* and FIG. 2*b* show cross-sections of 1×3 steel strands 20 and 25.

Steel strand 20 of FIG. 2*a* has three steel wires 21. Each of the steel wires 21 has a steel core 22 and is provided with a zinc coating 23. Indentions 24 have been made on each single wire 21.

Steel strand 25 of FIG. 2*b* differs from steel strand 20 in that indentions 26 are now made on the already twisted steel strand 25.

Figure 3A:
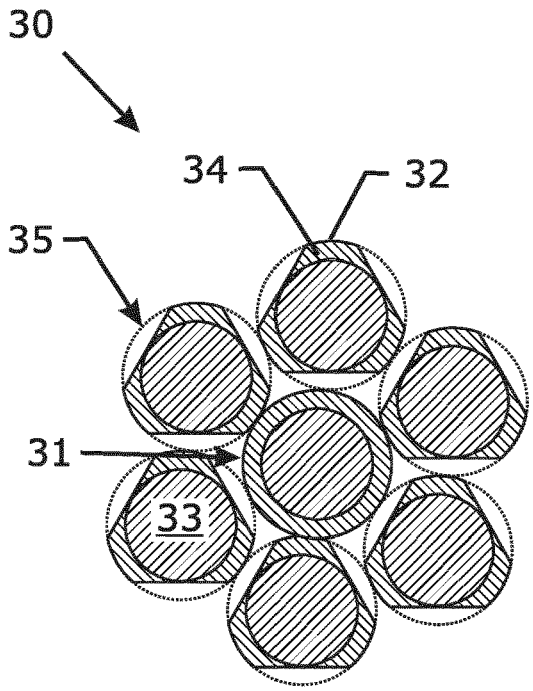
Figure 3B:
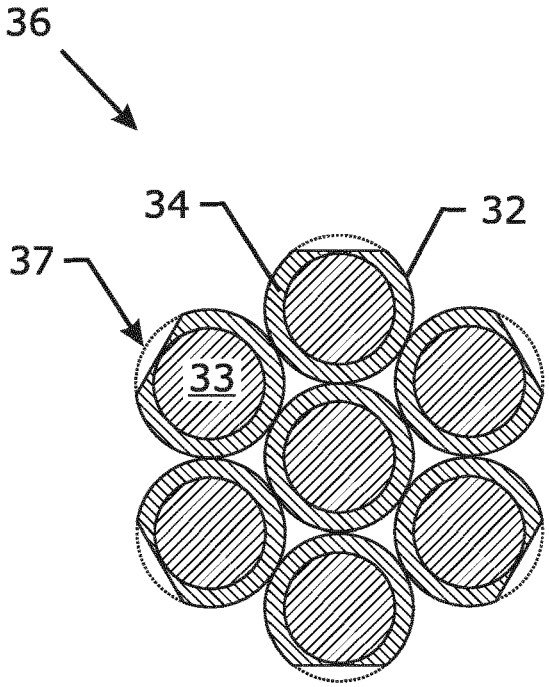

FIG. 3*a* and FIG. 3*b* show cross-sections of 1+6 steel strands 30 and 36.

Steel strand 30 or FIG. 3*a* has seven steel wires 31, 32: one core steel wire 31 surrounded by six mantle wires 32. Each steel wire 31, 32 has a steel core 33 and is provided with a zinc coating 34. Indentions 35 are provided on one or more of the individual mantle wires 32. Although it is not excluded to have indentions 35 on all six mantle wires 32, this is not needed, it is sufficient to have indentions on one, two, three, four, five or even six mantle wires 32.

Steel strand 36 of FIG. 3*b* differs from steel strand 30 in that the indentions 37 are now made on the already twisted steel strand 36.

Figure 4:
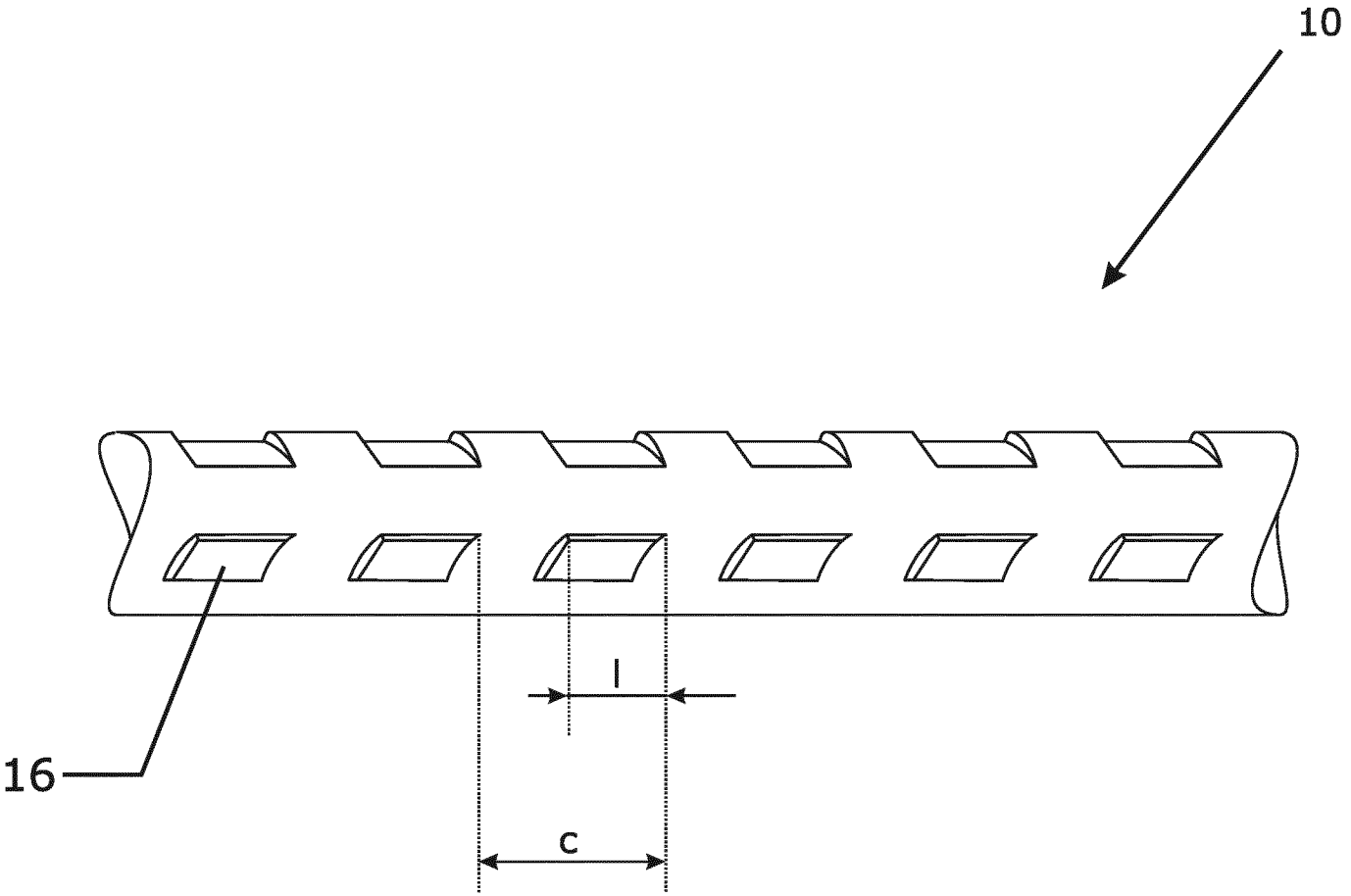
FIG. 4 is a longitudinal view of a single steel wire for reinforcing a pre-stressed concrete structure.

FIG. 4 is a longitudinal view of a steel wire 10 provided with indentions 16. The length $\ell$ of the indentions may range e.g. from 3.0 mm to 4.0 mm, e.g. from 3.3 mm to 3.7 mm. The spacing or pitch c between subsequent indentions may range from 5.0 mm to 6.0 mm, e.g. from 5.3 mm to 5.7 mm. The depth of the indentions may range from 0.05 mm to 0.20 mm, e.g. from 07 mm to 0.14 mm, e.g. from 0.08 mm to 0.12 mm.

Figure 5:
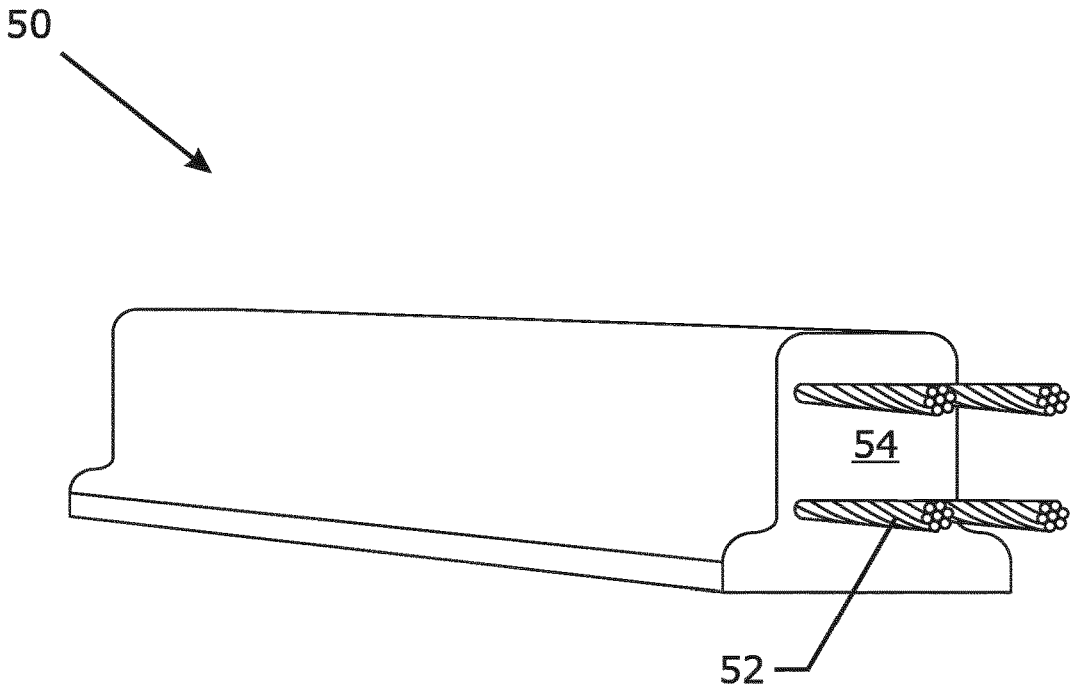
FIG. 5 is a perspective view a pre-stressed concrete beam.

FIG. 5 is perspective view of a pre-stressed concrete beam 50. Four 1+6 steel strands 52 with indentions reinforce a concrete matrix 54 and put the beam 50 under compression.

Four different 1+6 galvanized steel strands with a diameter of 15.24 mm (0.6 inch) have been evaluated regarding their bond strength according to the ASTM A1081-15 test method for evaluating bond of a seven wire steel prestressing strand. The difference between the strands was the number of indented layer wires:

the $1^{st}$ strand had no layer wires with indentions;

the $2^{nd}$ strand had one layer wire with indentions;

the $3^{rd}$ strand had three of the six layer wires with indentions, one layer wire with indentions alternating with a layer wire without indentions;

the $4^{th}$ strand had all six layer wires with indentions.

There were 24 specimens, six cast with each of the four strand types. Mortar flow was measured in accordance with the procedures specified in ASTM Test Method C1437 and was determined to be 112%.

Table 1 below lists the average pullout test results for each of the four strand types.

TABLE 1

| Strand type | Average ASTM A1081 Value (N) |
|---|---|
| $1^{st}$ strand - no indentions | 68126 |
| $2^{nd}$ strand - one indention | 77603 |
| $3^{rd}$ strand - three indentions | 90730 |
| $4^{th}$ strand - six indentions | 126729 |

Figure 6:
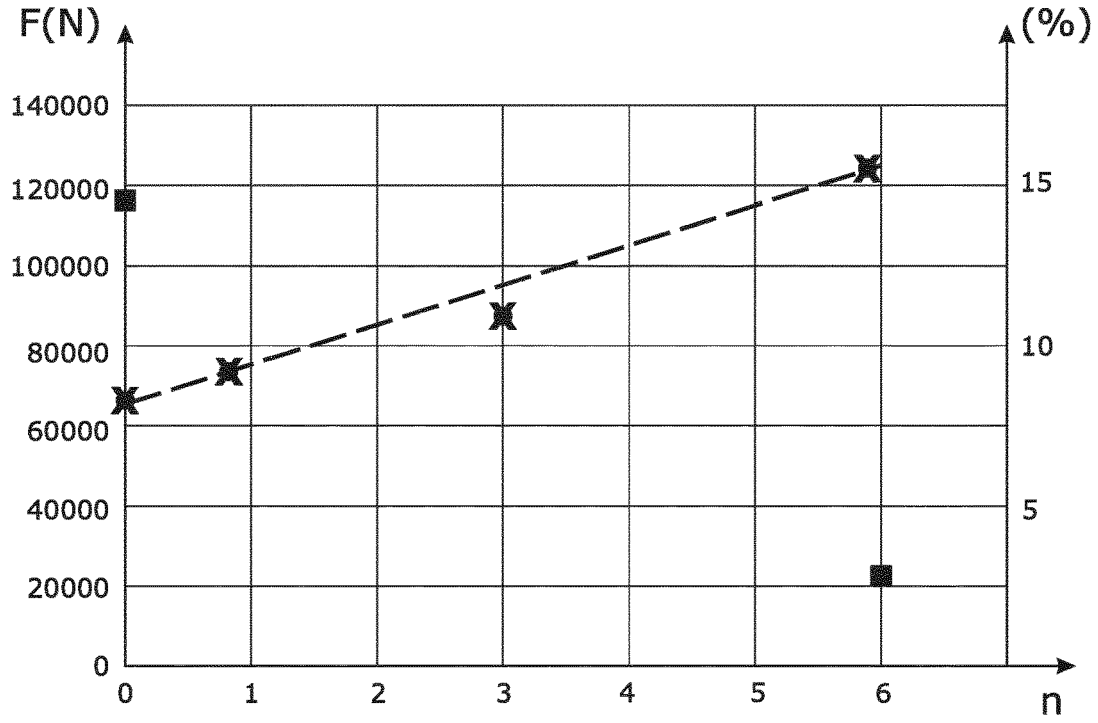
FIG. 6 is a graph illustrating test results on bond strength and on transfer length growth.

FIG. 6 puts these results in a graph. The abscissa is the number n of layer wires in a strand that have indentions. The left ordinate is the bond strength F in Newton. The average values are represented by 'x'. As the number of indented wires increases, the bond strength also increases. Almost a linear relationship between the bond strength F and the number n of layer wires with indentions exist.

In order to determine the decrease in beam transfer length growth, four pre-tensioned concrete beams were made:

two with a galvanized 1+6 strand without indentions;

two with a galvanized 1+6 strand with indentions provided on all the six layer wires.

The strands were initially tensioned at 75% of the minimum breaking strength. Tensioning was performed using mechanical gear jacks that were coupled to load cells. Concrete was cast and de-tensioning of the strands occurred over a period of couple of minutes once the concrete had reached a compressive strength of 38 MPa. End-slip values were obtained by measuring the distance that each strand slipped into the beam at the ends. Initial position was determined just after de-tensioning and the final position was determined 15 days after de-tensioning. The mast strand slip theory by Logan was determined to calculate the transfer length values.

The galvanized 1+6 strand without indentions showed an average increase of transfer length of 14.6%, whereas the galvanized 1+6 strand with six layer wires indented showed only an average increase of transfer length of 2.7%, which is a significant decrease.

FIG. 6 puts these results in a graph. The abscissa is the number of indented layer wires n, and the right ordinate is the percentage in increase of transfer length. The numerical results are represented by "■".

The above-mentioned results on bond strength and on decrease in transfer length of the galvanized indented strands are at least equally good as results obtained from comparable non-galvanized strands.

LIST OF REFERENCE NUMBERS

10 single steel wire
12 steel core of steel wire
14 zinc coating
16 indention
20 three wire steel strand
21 steel wire of three wire steel strand
22 steel core or steel wire

23 zinc coating
24 indention
25 three wire steel strand
26 indention
30 1+6 steel strand
31 core wire of 1+6 steel strand
32 layer or mantle wire of 1+6 steel strand
33 steel core of steel wire
34 zinc coating
35 indention
36 1+6 steel strand
37 indention
50 pre-stressed concrete beam
52 reinforcing strand
54 concrete matrix

The invention claimed is:

1. A pre-stressed concrete structure,
said structure comprising a steel wire or a steel strand,
said steel wire or said steel strand having been pre-tensioned before curing of the concrete or grout;
said steel wire or said steel strand being provided with a zinc coating,
said zinc coating having a weight ranging between 70 $g/m^2$ and 950 $g/m^2$;
said steel wire or said steel strand having an outer surface that is provided with indentions to provide mechanical anchorage points in said concrete structure;
said steel wire or said steel strand being provided with a passivation layer in the form of a metal oxide layer.

2. The concrete structure of claim 1,
wherein said steel wire or said steel strand has a yield strength that is more than or equal to 85% percent of the tensile strength.

3. The concrete structure of claim 1,
wherein said metal oxide layer is an oxide layer belonging to the group of zinc oxides, chromium oxides, zirconium oxides, aluminium oxides or a combination thereof.

4. The concrete structure of claim 1,
wherein said steel wire or said steel strand is a single steel wire.

5. The concrete structure of claim 1,
wherein said steel wire or said steel strand is a steel strand with three steel wires.

6. The concrete structure of claim 1,
wherein said steel wire or said steel stand is a steel strand with a 1+6 construction.

7. The concrete structure of claim 6,
wherein said steel strand has six mantle wires and where indentions are provided in some but not in all of the mantle wires.

8. The concrete structure of claim 1,
wherein said steel strands comprises steel wires,
and wherein said steel wires have a diameter ranging from 2.9 mm to 8.1 mm.

9. The concrete structure of claim 1,
wherein said indentions have a depth ranging from 0.05 mm to 0.20 mm.

* * * * *